US006037910A

United States Patent [19]

Solbach et al.

[11] Patent Number: 6,037,910

[45] Date of Patent: Mar. 14, 2000

[54] PHASED-ARRAY ANTENNA

[75] Inventors: Klaus Solbach, Senden; Tiang-Gwan Liem, Ulm, both of Germany

[73] Assignee: DaimlerChrysler Aerospace AG, Munich, Germany

[21] Appl. No.: 08/927,965

[22] Filed: Sep. 11, 1997

[30] Foreign Application Priority Data

Sep. 11, 1996 [DE] Germany ..... 196 36 850

[51] Int. Cl.[7] ..... H01Q 13/00; H01Q 13/10

[52] U.S. Cl. ..... 343/776; 343/778; 343/771

[58] Field of Search ..... 343/776, 778, 343/772, 853, 770, 771; 333/239, 240, 241, 242, 157, 158, 208

[56] References Cited

U.S. PATENT DOCUMENTS

| | | | |
|---|---|---|---|
| 3,237,134 | 2/1966 | Price | 333/208 |
| 4,939,527 | 7/1990 | Lamberty et al. | 343/771 |
| 5,532,706 | 7/1996 | Reinhardt et al. | 343/778 |

FOREIGN PATENT DOCUMENTS

| | | |
|---|---|---|
| 3803779 A1 | 8/1989 | Germany . |
| 3902739 A1 | 8/1990 | Germany . |

*Primary Examiner*—Don Wong
*Assistant Examiner*—Jennifer H. Malos
*Attorney, Agent, or Firm*—Venable; George H. Spencer; Norman N. Kunitz

[57] ABSTRACT

A phased-array antenna, particularly for the radar frequency range, comprising at least a predetermined number of transmit/receive radiator elements arranged linearly and/or matrix-shaped, a power distribution as well as a phase shifter network and a transmit/receive change-over arrangement. The transmit/receive change-over arrangement includes a serial feed comprising a waveguide with coupling in/coupling out locations disposed along its length and to which the phase shifter network, and possibly a further power distribution network, is coupled and also the transmitting/receiving arrangements are coupled. With this arrangement, an otherwise needed transmit/receive switch, for example, a circulator, is not necessary.

15 Claims, 2 Drawing Sheets

PHASED-ARRAY ANTENNA

REFERENCE TO RELATED APPLICATIONS

This application claims the priority of German Patent application No. DE 196 36 850.2, filed Sep. 11, 1996, which is incorporated herein by reference.

BACKGROUND OF THE INVENTION

The invention relates to a phased-array antenna of the type comprising a plurality of transmit/receive radiator elements arranged linearly, i.e., in rows, and in columns, a power distribution and phase shifter network for generating predetermined transmit/receive characteristics of the signals that are emitted and/or received by the transmit/receive radiator elements, and wherein a transmit/receive change-over takes place for the selective connection of the power distribution and phase shifter network to a transmitting and/or receiving arrangement.

Such antennas, particularly for radar applications, were disclosed, for example, in the German Unexamined Published Patent Applications DE-A 38 03 779, published Aug. 17, 1989, and DE-A 39 02 739, published Aug. 9, 1990, the subject matter of both of which is incorporated herein by reference. The arrangements or arrays described therein are substantially comprised of a plurality of transmit/receive radiator elements which are arranged linearly, e.g., in rows, or in the shape of a matrix. These transmit/receive radiator elements are connected to a transmitting/receiving arrangement known per se via a phase shifter arrangement, a power distribution network and a transmit/receive switch, e.g., in the form of a circulator. The power distribution network and the phase shifter arrangement serve to electronically form and/or swing a transmitting/receiving lobe. A decoupling of the transmit/receive signals is accomplished by the transmit/receive switch.

An arrangement of this type has the drawback that it is technically complex because a plurality of complex components is needed.

It is therefore the object of the invention to improve an arrangement of the generic type described above such that technically complex components, particularly the circulator, can be omitted.

SUMMARY OF THE INVENTION

The above object is achieved according to a first embodiment of the invention by a phased-array antenna, which comprises a plurality of transmit/receive radiator elements arranged linearly in rows and in columns; and a power distribution and phase shifter network for generating predetermined transmit/receive characteristics of the signals that are emitted and/or received by the transmit/receive radiator elements; wherein the power distribution network includes a serial feed line comprised of a waveguide having a first port at one end for coupling the waveguide to a transmitting arrangement and a second port at its other end for coupling the waveguide to a receiving arrangement, a predetermined number of coupling in/coupling out locations formed in the waveguide along its longitudinal direction to couple in/couple out the wave which can be guided in the waveguide, and a respective connecting waveguide coupled to each of the coupling in/coupling out locations to connect the waveguide with respective phase shifters of the phase shifter network.

The above object is achieved according to a another embodiment of the invention by a phased-array antenna, which comprises a plurality transmit/receive radiator elements arranged linearly and in columns; and a power distribution and phase shifter network for generating predetermined transmit/receive characteristics of signals that are emitted and/or received by the transmit/receive radiator elements; and wherein the power distribution network includes at least two partial networks with each partial network including a serial feed comprised of a waveguide having a predetermined number of coupling in/coupling out locations disposed in the waveguide along its longitudinal length for coupling in/coupling out the waves that can be guided in the waveguide, a respective connecting waveguide coupled to each of the coupling in/coupling out locations to connect the associated waveguide with a predetermined portion of the phase shifter network, with the waveguide of each partial network the having a connection for coupling the respective partial networks to respective ports of a coupler, and with the coupler having two further ports for coupling of a transmitting arrangement and of a receiving arrangement, respectively.

Advantageous further embodiments and/or modifications of the invention are disclosed.

The invention is based on the use of a serial feed line which has several coupling in/coupling out locations for the coupling in/coupling out of the transmit/receive signals that are used and which, in addition, has two ports for the coupling of the transmitting arrangement and of the receiving arrangement. With such a serial feed line, which serves at least in part as a power distribution network, and a phase shifter network coupled to the serial feed line, a transmit/receive change-over is possible in a surprising manner without necessitating a separate transmit/receive switch, in particular, a circulator. A serial feed line is comprised of a waveguide that is suitable for the transmitting/receiving wavelengths that are used, for example, a hollow waveguide, wherein a predetermined number of coupling locations, for example, coupling slots, are arranged at predetermined, equidistant intervals in the propagation direction of the guided wave. Thus, it is possible, for example, in the transmission case, to split a transmit signal that is guided in the waveguide into a predetermined number of individual transmit signals with predetermined transmitting power, with the number corresponding to the number of the coupling locations. The transmitting power is, in particular, a function of the design of the coupling locations, a fact known to a person skilled in the art. These individual transmit signals, which are associated, for example, with a complete line or row of radiator elements, are then supplied to the individual transmit/receive radiator elements via phase shifter networks and possibly power distribution networks.

The invention now makes use of the finding that the functioning of such a serial feed line, particularly the propagation direction of the guided wave, is a function of the amplitude relations and/or phase relations at the coupling locations.

The invention is described below in greater detail via embodiments with reference to schematically illustrated figures which show schematically illustrated power distribution networks.

DETAILED DESCRIPTION OF THE PREFERRED EMBODIMENTS

Figure 1:
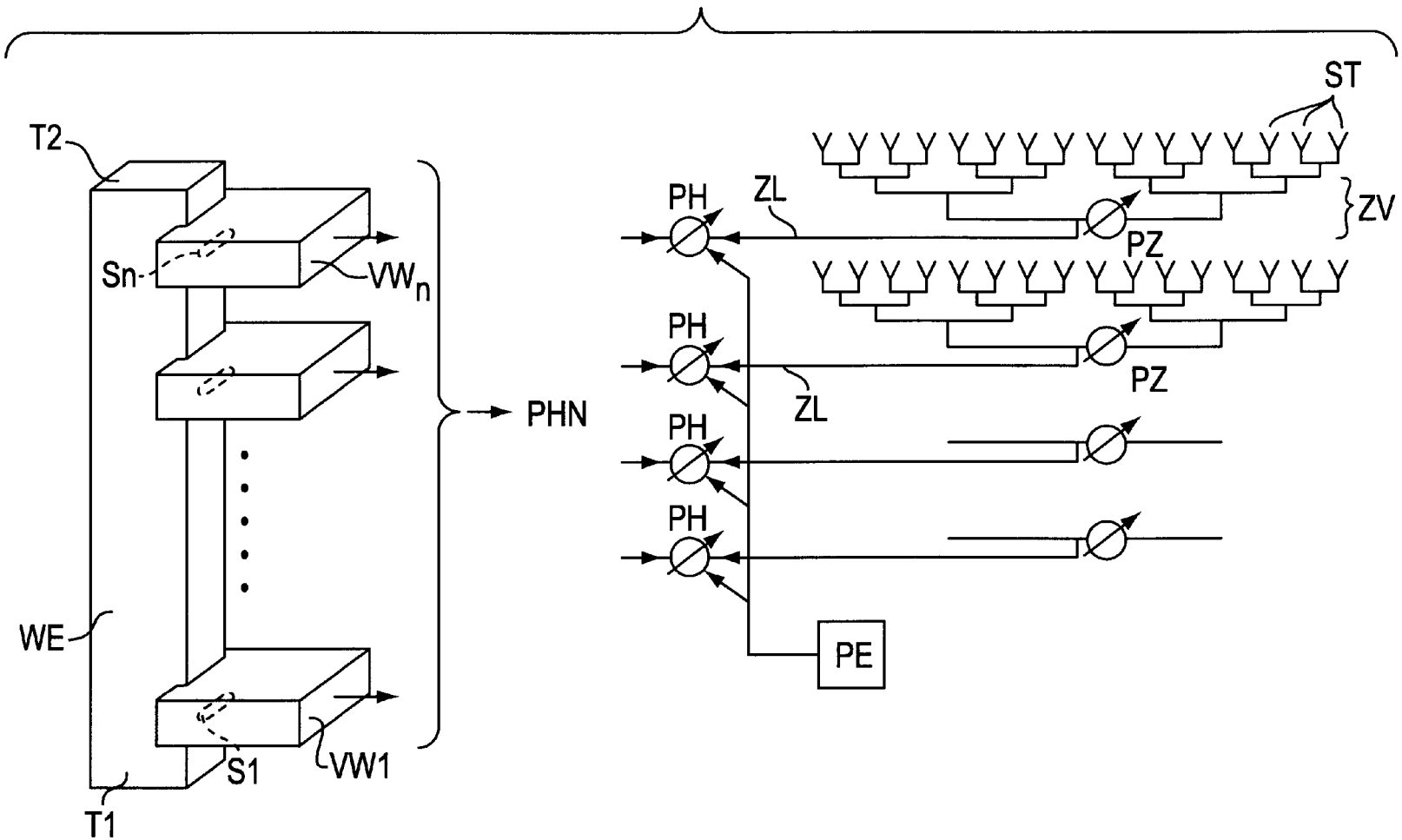
FIG. 1 is a schematic perspective view of a preferred embodiment of a serial feed line for the array antenna according to the invention.

FIG. 1 shows a waveguide WE, for example, a hollow waveguide with a rectangular-shaped cross section for the 5 GHz range. The waveguide WE has two ports T1, T2 and a predetermined number of equidistantly spaced coupling slots S1 to S*n*, with n being a predetermined integer number. The slots S1 to S*n* are configured as coupling in/coupling out slots for the wave (wavelength λ) that is guided in the waveguide WE and have a spacing of approximately λ/2 in the longitudinal direction of the waveguide WE (propagation direction of the wave). A respective associated connecting waveguide VW1 to VW*n* (connecting hollow waveguide) is coupled to each of the coupling in/coupling out slots S1 to S*n*. These connecting waveguides VW1–VW*n* lead to respective phase shifter networks known per se, identified generally by PHN, which are not shown in detail but which are disclosed in the above identified and cited references, and are each associated with a row of transmit/receive radiator elements ST according to the above cited references. In general, as illustrated, the radiators ST for the array antenna are arranged in several radiator rows Z, one above the other, and are respectively connected via a row distribution ZV with a respective line feeder ZL. The share of the transmitting power that is assigned to a respective radiator row is supplied via the respective connecting waveguides VW1–VW*n* to the feeder lines ZL for the rows, wherein electronically controllable phase shifters PH are located. The shape and the main radiating direction for the antenna pattern can be adjusted with the aid of these phase shifters PH and can also be varied from radar cycle to radar cycle. The phase shifters are adjusted with a phase control unit PE, which generates the adjustment values for the phase shifters PH upon receiving predetermined values for the desired shape and main radiating direction for the antenna pattern in elevation. Additional phase shifters PZ may be provided in the row distributions as shown, and can be used for a varied adjustment of the phase positions at the individual radiators ST for groups of individual radiators.

If, for example, a transmit signal is coupled into port T1 as a continuous wave, portions of the wave are coupled out at the respective coupling in/coupling out slots S1 to S*n* and are guided to the transmit/receive radiator elements ST via the connecting waveguides VW1 to VW*n* and the phase shifter network PHN. A swinging of the transmit lobe (transmission characteristic) is then possible in a known manner by means of the phase shifters.

In the reception case, the signal received from the transmit/receive radiator elements, for example, the echo signals associated with the transmit signal, are guided into the waveguide WE via the phase shifters of the phase network PHN and the connecting waveguides VW1 to VW*n*. It is now possible in an advantageous manner to set via the control PE, the phase shifters PH in this reception case such that the receive signal which is being generated in the waveguide WE can be coupled out at the second port T2. At most, only a negligible (reflection) portion of the received signal is generated at the first port T1. The receive signal, which was generated at the second port T2, is then supplied in a manner known per se, for example, via hollow waveguides, to a (radar) receiver where it is evaluated.

This means that a separation of the transmit signal, which is coupled into the first port T1, from the receive signal, which is coupled out of the second port T2, is possible in the manner described above without using an additional transmit/receive switch, for example, a circulator. The transmit/receive change-over process described takes place solely via a shifting or adjustment of the phase shifters of the network PHN by values which are a function of the phase progression of the serial feed line WE and the elevation pivot angle of the beam characteristic that is to be set; a person skilled in the art is familiar with the corresponding calculation.

It is obvious that the above-described arrangement with a plurality of hollow waveguides likewise can be produced, for example, by so-called stripline or microstrip or coaxial technology.

Figure 2:
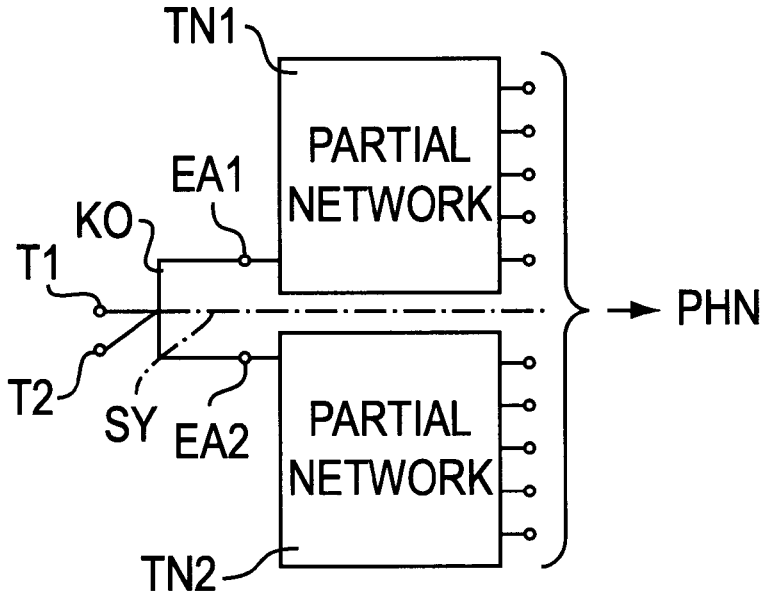
FIG. 2 is a schematic diagram of a second embodiment of a feed arrangement according to the invention using a pair of serial feed lines according to FIG. 1.

FIG. 2 shows a further example wherein two partial networks TN1, TN2 are arranged symmetrically relative to a symmetry line SY. Each of the partial networks TN1, TN2 is designed, for example, according to FIG. 1, but with the difference that there is a single coupling in/coupling out connection or port EA1, EA2, for each network TN1, TN2, respectively. These coupling in/coupling out connections terminals correspond, for example, to port T1 (FIG. 1), with port T2 (FIG. 1) being closed off with a termination impedance (HF absorbing layer). As described with reference to FIG. 1, the partial networks TN1, TN2 are coupled to transmit/receive radiator elements via phase shifter networks PHN. The coupling in/coupling out connections EA1, EA2 are connected to respective ports of a coupler KO which is configured as a 3 dB hybrid, for example, as a so-called "magic T" or as a 3 dB directional coupler. This coupler KO also has a (transmit) port T1 and a (receive) port T2 whose function was already described with regard to FIG. 1. In (radar) antenna engineering, the arrangement described according to FIG. 2 corresponds to an arrangement for the generation of sum/difference patterns. With the arrangement described it is possible, for example, to set the phase shifters for a transmit signal that is coupled in at port T1 in such a manner that the transmit/receive radiator elements emit (radiate) a sum/difference pattern known from radar engineering. As described with regard to FIG. 1, it is also possible in the reception case to adjust the phase shifters such that the receive signal of the same sum pattern can be coupled out at port T2. The position change of the phase shifters necessary for this purpose amounts to 180° in one of the two halves of the phase shifter network. In this process, a desirably high decoupling, for example, larger than 20 dB, can be produced between the ports T1, T2 if the coupler KO (hybrid) has a correspondingly high decoupling for a reflection-free termination and, in addition, if care is taken to ensure that the arrangement illustrated in FIG. 2 is designed symmetrically with respect to the guided waves and also has the smallest possible reflection coefficients. Advantageously, the above-described arrangement can also be produced by a different line technology, as was described above with regard to FIG. 1.

Figure 3:
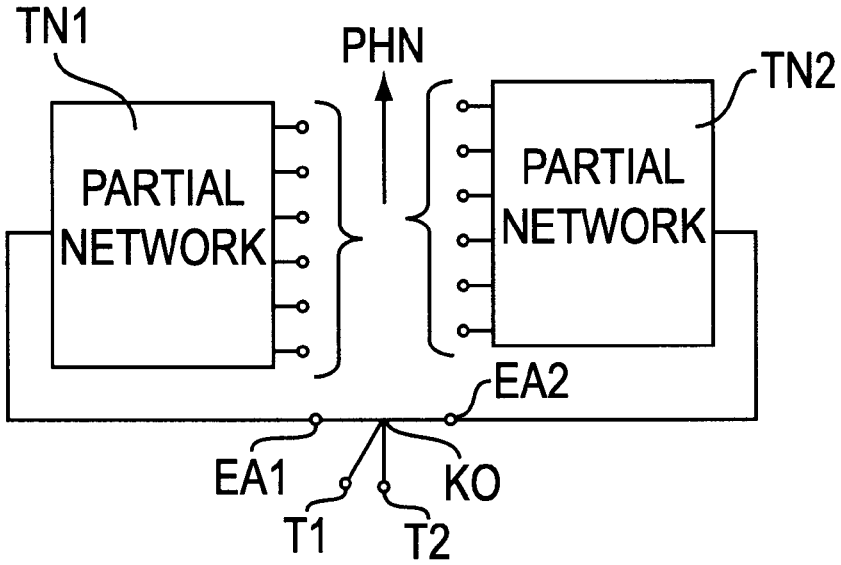
FIG. 3 shows a modification of the arrangement of FIG. 2.

The embodiment according to FIG. 3 differs from the one in FIG. 2 merely in the connection diagram of the transmit/receive radiator elements. In contrast to FIG. 2, where one half of the transmit/receive radiator elements is entirely connected to a single partial network TN1 or TN2, the arrangement according to FIG. 3 provides for a type of alternating connection. For continuously numbered transmit/receive radiator elements, all odd-numbered transmit/receive radiator elements are coupled to a single partial network, for example, TN1, during this process, and all even-numbered elements to the other partial network, here TN2. This toothed or interleaved coupling permits the generation of a sum pattern for a receive signal at port T1, while a signal that is coupled out at port T2 does not correspond to a difference pattern. Advantageously, this arrangement can also be produced by the already mentioned various line technologies.

For the examples described above, only the phase shifters (phase advancers) must be changed over from transmitting to receiving or vice versa. A plurality of presently customary phase shifters are suitable for such phase change-over processes, for example, delay lines. The invention is particularly advantageous if non-reciprocal phase shifters (ferrite phase shifters) are already used in the transmitting/receiving arrangement because these phase shifters must be changed over during each transmit/receive change-over process. During this change-over process, the additional above-described phase shift can then take place without any added complexity.

The invention now being fully described, it will be apparent to one of ordinary skill in the art that any changes and modifications can be made thereto without departing from the spirit or scope of the invention as set forth herein.

What is claimed:

1. A phased-array antenna, comprising:

a plurality of transmit/receive radiator elements arranged linearly in rows and in columns; and, a power distribution and phase shifter network for generating predetermined transmit/receive characteristics of the signals that are emitted and/or received by the transmit/receive radiator elements; and, wherein the power distribution network includes, for achieving a transmit/receive changeover for a selective connection of the power distribution and phase shifter network to a transmitting and/or receiving arrangement, a serial feed line comprised of a waveguide having a first port at one end for coupling the waveguide to a transmitting arrangement and a second port at its other end for coupling the waveguide to a receiving arrangement, a predetermined number of coupling in/coupling out locations formed in the waveguide along its longitudinal direction to couple in/couple out the wave which can be guided in the waveguide, and a respective connecting waveguide coupled to each of the coupling in/coupling out locations to connect the waveguide with respective phase shifters of the phase shifter network.

2. A phased-array antenna according to claim 1 wherein the coupling in/coupling out locations are equidistantly spaced along the longitudinal direction of the waveguide.

3. The phased-array antenna according to claim 2 wherein the coupling in/coupling out locations are spaced by $\lambda/2$, where $\lambda$ is the wavelength of the wave in the waveguide.

4. A phased array antenna according to claim 1, wherein the power distribution and phase shifter network generator includes means for controlling the respective phase shifters to generate transmit/receive characteristics to cause a change in the direction of the wave propagated in the waveguide during reception of a signal relative to the wave propagation direction in the waveguide during transmission of a signal.

5. A phased-array antenna, comprising: p1 a plurality transmit/receive radiator elements arranged linearly and in columns: p2 a power distribution and phase shifter network for generating predetermined transmit/receive characteristics of signals that are emitted and/or received by the transmit/receive radiator elements; and p2 wherein, for a transmit/receive change-over to selectively connect the power distribution and phase shifter network to a transmitting and/or receiving arrangement, the power distribution network includes at least two partial networks with each partial network including a serial feed comprised of a waveguide having a predetermined number of coupling in/coupling out locations disposed in the waveguide along its longitudinal length for coupling in/coupling out the waves that can be guided in the waveguide, a respective connecting waveguide coupled to each of the coupling in/coupling out locations to connect the associated waveguide with a predetermined portion of the phase shifter network, with waveguide of each partial network the having a connection for coupling the respective partial networks to respective ports of a coupler, and with the coupler having two further ports for coupling of a transmitting arrangement and of a receiving arrangement, respectively.

6. A phased-array antenna according to claim 5, wherein the transmit/receive radiator elements are divided into at least two predetermined groups, with each group being associated with a particular partial network.

7. A phased-array antenna according to claim 6, wherein, for an allocation, all transmit/receive radiator elements are numbered serially, and each said group also includes serially numbered transmit/receive radiator elements.

8. A phased-array antenna according to claim 6, wherein all of the transmit/receive radiator elements are numbered serially for an allocation, the transmit/receive radiator elements are divided into two groups, with all odd-numbered transmit/receive radiator elements being combined in one group and all even-numbered transmit/receive radiator elements being in the other group.

9. A phased-array antenna according to claim 5, wherein the coupler is a magic-T.

10. A phased-array antenna according to claim 5, wherein the coupler is a 3 dB coupler.

11. A phased-array antenna according to claim 5, wherein at least the waveguide included in each partial network is a hollow waveguide, and the coupling in/coupling out locations are coupling in/coupling out slots formed in the waveguide.

12. A phased-array antenna according to claim 11, wherein at least the waveguide included in each partial network and the coupling in/coupling out slots are formed by stripline technology.

13. A phased-array antenna according to claim 11, for use in the radar frequency range.

14. A phased-array antenna according to claim 11, wherein the slots are spaced by $\lambda/2$, wherein $\lambda$ is the wavelength of the wave in the waveguide.

15. A phased array antenna according to claim 1, wherein the power distributor and phase shifter network generator includes means for controlling the respective phase shifters to generate transmit/receive characteristics to cause a change in the direction of the wave propagated in the waveguide during reception of a signal relative to the wave propagation direction in the waveguide during transmission of a signal.

* * * * *